US006634524B1

(12) United States Patent
Helmenstein

(10) Patent No.: US 6,634,524 B1
(45) Date of Patent: Oct. 21, 2003

(54) TWO-COMPONENT CARTRIDGE FOR FREE-FLOWING MEDIA

(75) Inventor: Achim Helmenstein, Engelskirchen (DE)

(73) Assignee: Fischbach KG Kunststoff-Technik, Engelskirchen (DE)

( * ) Notice: Subject to any disclaimer, the term of this patent is extended or adjusted under 35 U.S.C. 154(b) by 0 days.

(21) Appl. No.: 10/070,274

(22) PCT Filed: Sep. 7, 2000

(86) PCT No.: PCT/EP00/08739

§ 371 (c)(1),
(2), (4) Date: Mar. 6, 2002

(87) PCT Pub. No.: WO01/19700

PCT Pub. Date: Mar. 22, 2001

(30) Foreign Application Priority Data

Sep. 14, 1999 (DE) ..... 199 43 877

(51) Int. Cl.[7] ..... B65D 35/22

(52) U.S. Cl. ..... 222/94; 222/95; 222/105; 222/145.5; 222/326

(58) Field of Search ..... 222/92, 94, 95, 222/105, 145.5, 145.6, 157, 158, 326, 386

(56) References Cited

U.S. PATENT DOCUMENTS 2,318,928 A * 5/1943 Deighton ..... 222/95
3,774,603 A * 11/1973 McPhee ..... 604/246
4,340,154 A * 7/1982 VanManen ..... 222/94
5,310,091 A * 5/1994 Dunning et al. ..... 222/135
5,328,056 A * 7/1994 Schneider et al. ..... 222/94
5,582,327 A * 12/1996 de Laforcade ..... 222/1
5,647,510 A * 7/1997 Keller ..... 222/94
6,439,274 B1 * 8/2002 DeBoisblanc ..... 141/67
6,454,129 B1 * 9/2002 Green ..... 222/94

FOREIGN PATENT DOCUMENTS

DE 2 007 199 2/1970
DE 29 39 116 A1 9/1979

* cited by examiner

*Primary Examiner*—Joseph A. Kaufman
(74) *Attorney, Agent, or Firm*—Diller, Ramik & Wight

(57) ABSTRACT

The two-component cartridge comprises an outer container (10) and an inner container (20) coaxially arranged therein. The inner container (20) comprises a bellows-type section (21) adapted to be folded like an accordion. The rear end of the bellows-type section (21) is inserted into a piston (32). In the folded condition, the bellows-type section is accommodated in an annular space (41) of the piston (32). The piston (32) comprises an annular piston breast (34) and a central piston breast (37) arranged at the same level. The invention allows easy filling of the two-component cartridge from the rear side and almost complete evacuation. The two-component cartridge can be evacuated by means of the same tool as is used for a common cartridge containing only a single material.

17 Claims, 3 Drawing Sheets

TWO-COMPONENT CARTRIDGE FOR FREE-FLOWING MEDIA

BACKGROUND OF THE INVENTION

The invention relates to a two-component cartridge, in particular a cartridge for discharging components of adhesives or foamed materials which are intended to get in contact with each other not before having been discharged, for the purpose of being mixed such that they react on each other.

Numerous solutions are known for two-component cartridges where the two components are stored separately from each other and are discharged at the same time and mixed with each other. In this connection a distinction is generally made between a coaxial cartridge and a biaxial cartridge. In the case of a coaxial cartridge an inner container is coaxially arranged inside an outer container. For simultaneous discharge of the two components by means of a commercially available standard evacuating means destined for a one-component cartridge an additional evacuating tool is required which comprises an inner mandrel and an annular mandrel of great length. When such a coaxial cartridge is used in connection with a conventional evacuating tool, said cartridge may have only half the length of a common cartridge because of the length of the required evacuating tool. In the case of biaxial two-component cartridges two containers each having a separate piston are arranged side by side. Here, a complex evacuating tool is needed. This solution requires high evacuating forces.

From DE-OS 2 007 199 an evacuating device for liquid cosmetic products is known where the one component is contained in an inner container and the other component is contained in an outer container. The inner container is adapted to fold like an accordion and its rear end is fastened to a piston which is displaceably arranged in the outer container. When the piston is advanced, the component contained in the outer container is moved in forward direction and the component contained in the inner container is also discharged because of the reduced volume of the inner container. According to another solution the piston comprises an annular space in which a knife is disposed which cuts up the cylindrical wall of the inner container when the piston is advanced in order to provide space for further advancement of the piston.

From DE 29 39 116 A1 a two-component cartridge is known which comprises an outer container, an inner container coaxially arranged therein and configured as a bellows-type section, and a piston displaceably arranged in the outer container. The piston is provided with a recess whose bottom supports the inner container. For displacing the piston the inner container is folded and received by the recess of the piston. The inner container is configured as a bag which is closed at the rear end by the bottom of the bag.

SUMMARY OF THE INVENTION

It is an object of the invention to provide a two-component cartridge for flowable media, which is easy to fill with the two components being kept separate from each other, and allows residual discharge of the two components.

In the two-component cartridge according to the invention the inner container comprises at its rear end a filling opening which is open at first and is closed by the piston when the material has been filled in. The piston comprises a projection axially extending into the inner container, said projection forming a central piston breast. The function of the piston projection is, on the one hand, that its central piston breast ensures maximum residual discharge of the component in the inner container, and on the other hand, that it forms a mandrel for ordered accommodation of the inner container when the latter is folded.

The two-component cartridge according to the invention can be evacuated using a commercially available standard evacuating means destined for one-component cartridges.

Good filling capability of the cartridge results from the fact that prior to placement of the piston both the inner container and the outer container are open at the rear end such that the two materials can be pressed into the respective filling opening. The materials can be pressed in simultaneously or one after the other.

Preferably, the projection provided on the piston forms, together with a recess of the piston and/or together with a constricted portion of the outer container, an annular space which receives the folded inner container when the piston is in the advanced position. This promotes the ordered folding of the inner container, and consequently an extremely small amount of residue of the corresponding component remains in the container.

The two-component cartridge according to the invention offers the possibility to accommodate the hazardous component of the two component materials in the inner container since the latter offers a residual evacuation capability. When the cartridges have been emptied, there is no danger that persons get in contact with a residue of the hazardous component which has not yet reacted. In the case of conventional coaxial cartridges it is however possible that the container wall shows fissure-type leaky areas and resultant leakage and adhesion of residues. The annular space receiving the folded inner container also reduces the amount of residue and forces the inner container into the form provided for the compressed condition.

According to a preferred embodiment of the invention it is provided that the piston comprises two separate piston portions of which a first piston portion comprises the first piston breast and a second piston portion comprises the second piston breast, and that one of the piston portions has a supporting surface for supporting and advancing the other piston portion. This allows the two containers to be filled one after the other and the filled container to be closed by inserting the respective piston portion. This prevents the two components from unintentionally getting into contact with each other. During the evacuation process the pressure is directly exerted only on one of the piston portions, and this piston portion supports and advances the other piston portion.

Each piston portion may comprise a piston edge supported on the wall of the outer container. In this way each piston portion is individually centered in the outer container.

The inner container is preferably configured as a bellows-type section being corrugatedly folded. The inner container is self-supporting and dimensionally stable. It is plastically deformable. For these requirements a metal is suited, in particular aluminum or an aluminum alloy. Aluminum offers the advantage that it has good plastic deformation characteristics. It has turned out that a bellows-type section of thin-walled aluminum is excellently suited as inner container.

Hereunder an embodiment of the invention is explained in detail with reference to the drawings in which:

DESCRIPTION OF THE PREFERRED EMBODIMENTS

Figure 1:
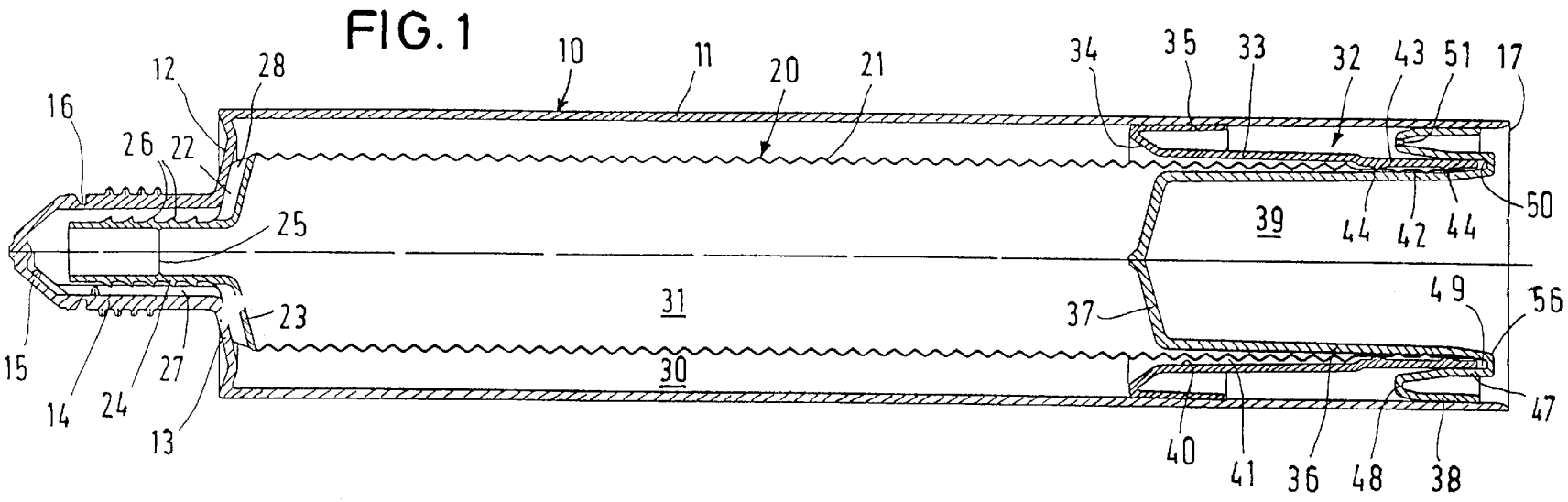
FIG. 1 shows a longitudinal section of a first embodiment of the two-component cartridge in the filled condition.
Figure 2:
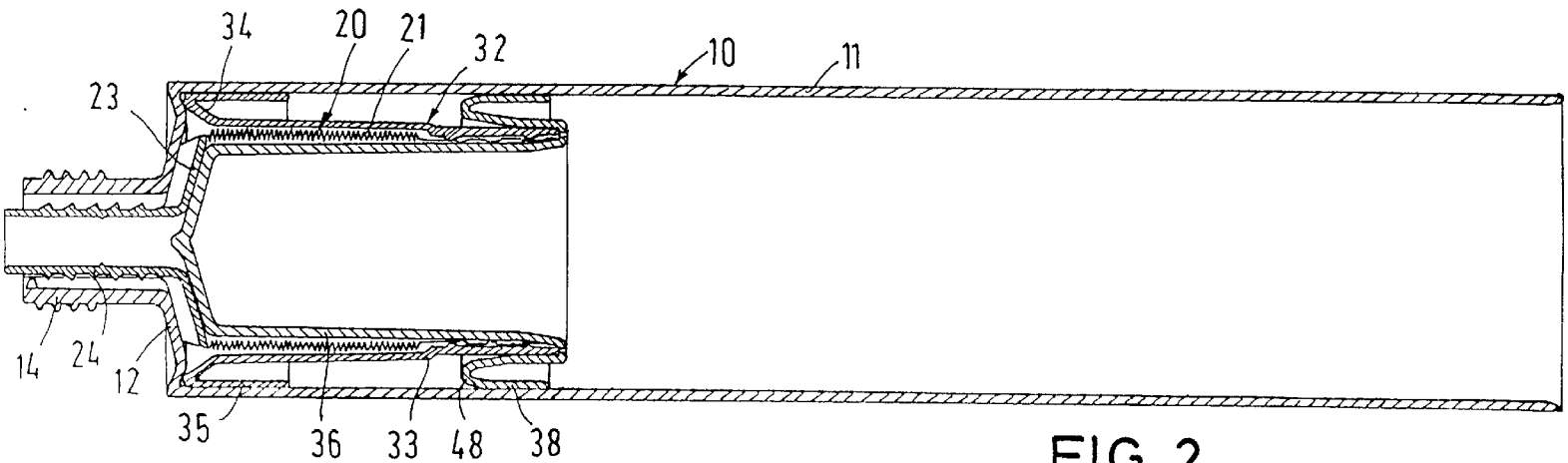
FIG. 2 shows a longitudinal section of the first embodiment in the evacuated condition.
Figure 4:
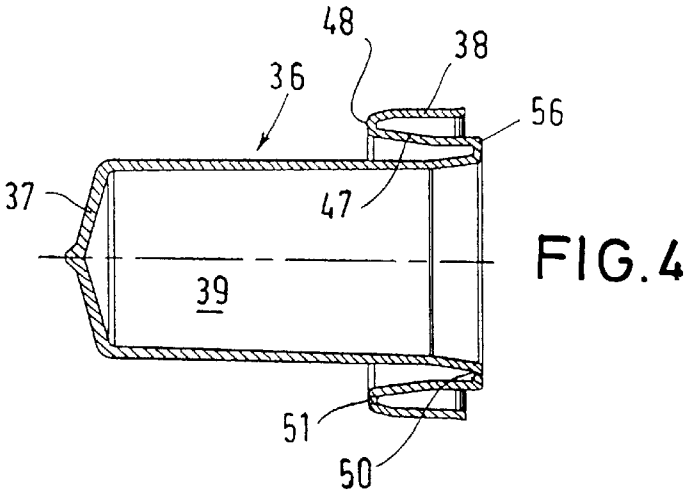
FIG. 4 shows a longitudinal section of the second piston portion.
Figure 3:
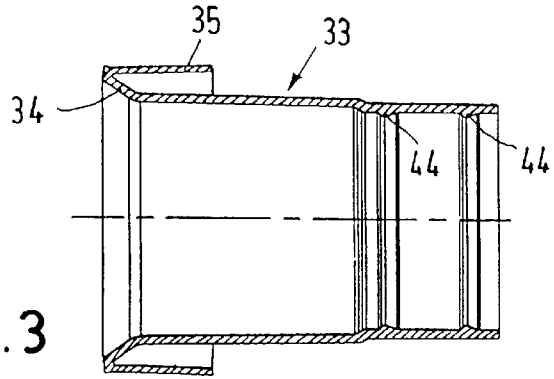
FIG. 3 shows longitudinal section of the first piston portion.
Figure 5:
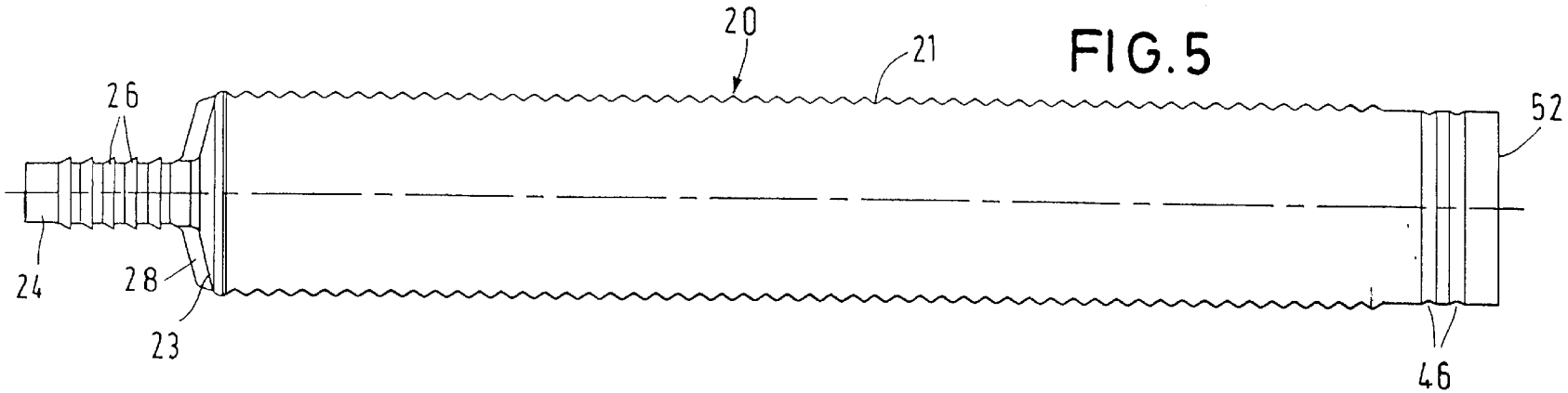
FIG. 5 shows a part-sectional view of the inner container.

The two-component cartridge shown in FIGS. 1–5 is adapted to accommodate flowable materials, in particular components of adhesives or foamed materials. It comprises an outer container 10 having an elongate cylindrical cartridge body 11 of plastic material. The outer container 10 is closed at its front end 12 by a front wall 13 from which a outlet channel 14 extends. Said outlet channel is closed by an integral cap 15 which can be removed at a circumferential annular groove 16. The rear end 17 of the outer container 10 is open.

In the outer container 10 the inner container 20 is coaxially arranged. The latter comprises an essentially cylindrical bellows-type section 21 of aluminum. At the front end 22 of the bellows-type section 21 a container breast 23 is provided from which an inner outlet channel 24 extends coaxially in the outer outlet channel 14. The inner outlet channel 24 may comprise a separating film 25 adapted to be pushed open.

On the outside of the tubular outlet channel 24 circumferential sawtooth ribs 26 are arranged which are squeezed into longitudinal webs 27 on the inside of the outer outlet channel 14. The ribs 26 allow insertion of the inner outlet channel 24 into the outer outlet channel 14 but prevent it from being retracted. The inner outlet channel 24 is centered in the outer outlet channel 14 and thus the front end 22 of the inner container 20 is centered relatively to the outer container 10.

On the outside of the container breast 23 ribs 28 are provided which hold the container breast 23 at a distance to the front wall 13. At the rear end of the inner container 20 circumferential beads 46 are located which sealingly engage the inner surface of the one annular piston portion 33, and therebehind a filling opening 52 (FIG. 5) is provided which is later closed by the piston 32.

Between the inner container 20 and the outer container 10 an annular space 30 is provided which receives the first component. The space 31 inside the inner container 20 receives the second component.

The rear end 17 of the outer container 10 is closed by a piston 32. Said piston comprises a first piston portion 33 having an annular piston breast 34 and a circumferential piston edge 35 pressing against the inside of the outer container, and a second piston portion 36 having a central piston breast 37 and a piston edge 38 also pressing against the inside of the outer container 10. The piston 32 comprises a projection which is open from the rear end. The second piston breast 37 is located at the projection 39 of the piston portion 36, which extends into the open end of the inner container 20. It is disposed approximately at the same level as the outer piston breast 34. The projection 39 coaxially extends into a recess 40 of the piston portion 33. Between the projection 39 and the recess 40 an annular space 41 is provided which can receive the folded inner container 20.

Behind the annular space 41 a narrowed insertion zone 42 is located in which a constricted section 43 of the first piston portion 33 is provided with circumferential ribs 44 directed towards the inside, said ribs 44 pressing against the rear end of the cylindrical area of the inner container 20. In this area the inner container 20 is provided with beads 46 directed towards the inside (FIG. 5), which are located between the ribs 44 and pressing against the outer surface of the projection 39.

The piston portion 36 comprises at its rear end a bend 56 extending via a collar 47 directed towards the front and another bend 48 into the piston edge 38 directed towards the rear. At the bend 56 the piston portion 39 forms a pocket 49 into which extends the rear end of the piston portion 33 and where it is supported by a supporting surface 50, namely the inner surface of the bend 56. In the bend 48 small openings 51 are provided which allow perfect venting when the piston is placed.

First, the empty inner container 20 is fixed in the outer container 10 by centering the inner outlet channel 24 in the outer outlet channel 14. The inner container 20 is dimensionally stable and cannot be radially expanded by the internal pressure produced during the filling process.

The two components are filled in successively from the rear end 17, wherein the piston 32 is not yet placed. Optionally, the one or the other component can be filled in first. Preferably, the annular space 30 is filled first. Then the piston portion 33 is placed in position, wherein the air can escape from below the circumferential ribs 44. Then the space 31 is filled with the other component, and finally the second piston portion 36 is placed in position, whereby the rear end 17 of the cartridge is closed. In this condition shown in FIG. 1 the cartridge is supplied to the user.

During the evacuation process the advancing disk of an evacuating tool presses against the rear end of the piston 32, whereby the two piston portions 33 and 36 are advanced to the same extent. During this process the inner container 20 folds like an accordion. The bellows-type section is configured with an corrugating folding such that the folding process proceeds from rear to front. The corrugation of the bellows-type section is selected such that the bellows-type section, in the folded condition, gets jammed in the annular gap 41 and sealingly fills the latter. At the end of the advance movement the bellowstype section in its folded condition is, according to FIG. 2, completely accommodated in the annular space 41. The first piston breast 34 matches the inside of the front wall 13, and the second piston breast 37 matches the container breast 23 of the inner container. In the completely advanced condition the piston breast 37 abuts on the container breast 23, and the piston breast 34 abuts on the front wall 13. Thus both spaces are almost completely evacuated.

For detection of the existing residue in the cartridge at each stage, the outer container 10 is at least partly made from a translucent material. On the outside a scale indicating the respective state of evacuation on the basis of the piston position is provided. The position of the piston 32 can be seen through the cartridge wall.

Figure 6:
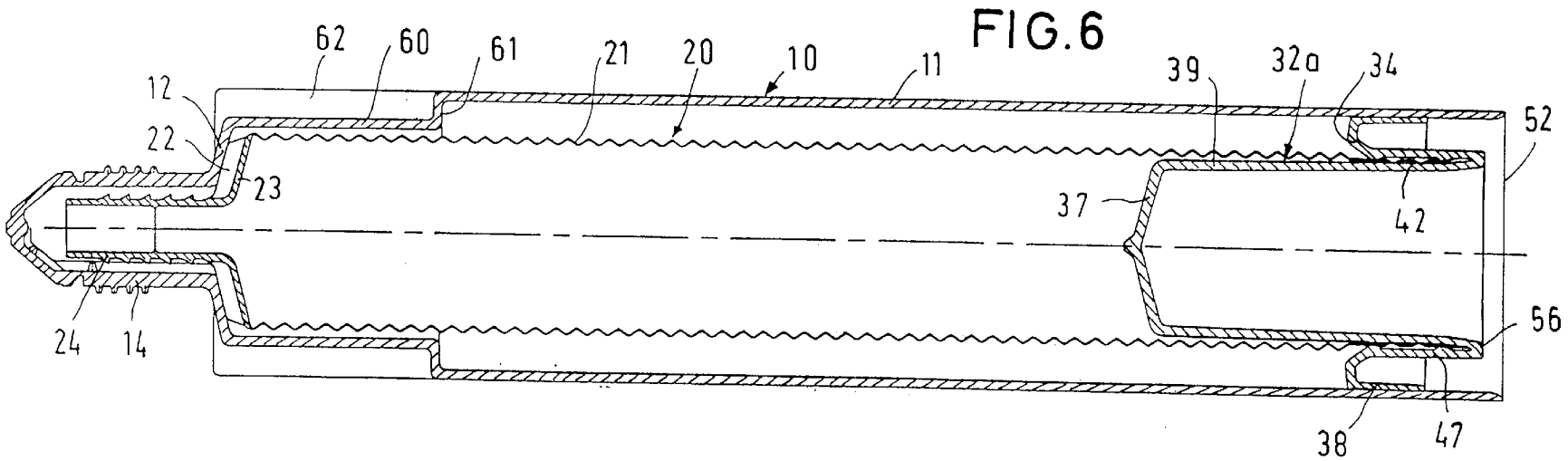
FIG. 6 shows a longitudinal section of a second embodiment of the two-component cartridge in the filled condition.
Figure 7:
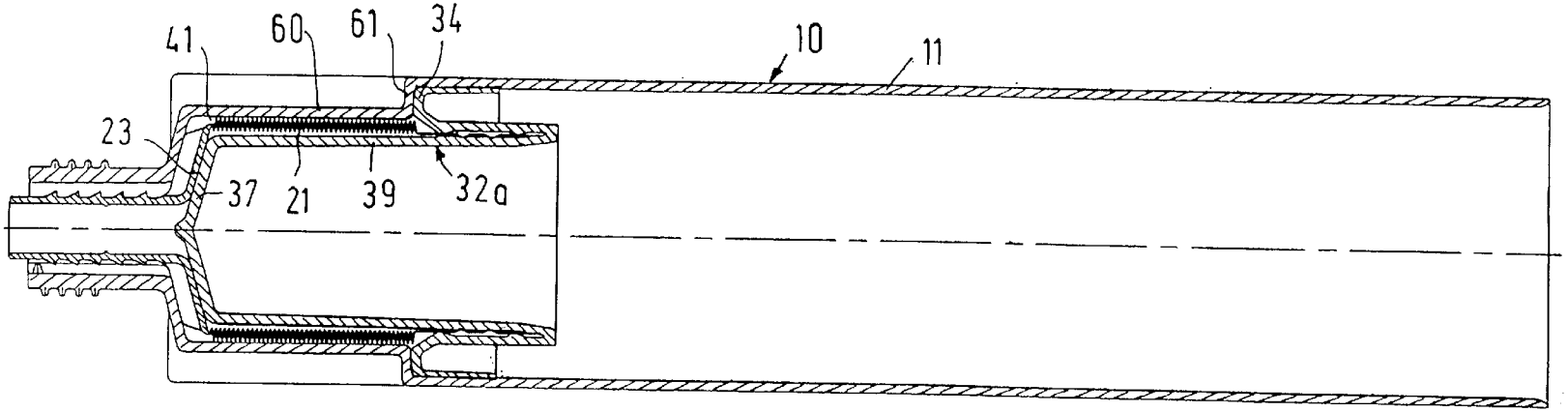
FIG. 7 shows a longitudinal section of the second embodiment in the evacuated condition.

The embodiment shown in FIGS. 6 and 7 essentially corresponds to the first embodiment such that the following description is limited to the explanation of the differences. In the second embodiment the piston 32*a* comprises a single piston portion. It is provided with the projection 39 extending into the rear end of the inner container 20, with an insertion zone 42 being formed at the rear end of the projection 39. At the rear end the projection 39 passes via a bend 56 into a collar 47 directed towards the front, which is joined by the outer annular piston breast 34. Said annular piston breast 34 is arranged at a position much more at the rear than the central piston breast 37.

At the front end the cylindrical outer container 10 comprises a constricted portion 60. In the area of said constricted portion the cylinder wall has a smaller diameter than in the remaining area of the cartridge body 11. The constricted portion 60 is defined by a shoulder 61. In the area of the constricted portion 60 longitudinal ribs 62 may be provided. The length of the constricted portion 60 is equal to the length of the area of the projection 39 protruding beyond the piston breast 34 such that in the evacuation condition shown in FIG. 7 the central piston breast 37 abuts on the container breast 23 of the inner container, while the annular piston breast 34 bears against the shoulder 61. Between the constricted portion 60 and the projection 39 the annular space 41 is formed which receives the compressed bellows-type section 21.

In the second embodiment, too, the inner container and the outer container are first filled with the respective component, wherein the two components are strictly separated from each other. After the filling process the piston 32*a* is placed and, in the insertion zone 42, the rear end of the inner container 20 is inserted from both sides into the piston. Since the projection 39 is first immersed into the inner container and closes the latter, it is reliably prevented that the two components unintentionally get in contact with each other during placement of the piston. Here, too, folding of the bellows-type section 21 is effected from the rear end and proceeds towards the front, wherein the folded bellows-type section is received by the projection 39 acting as a mandrel.

I claim:

1. Two-component cartridge for flowable media comprising a tubular outer container (10) having a front end (12) and an open rear end (17), said front end (12) having an outer outlet channel (14), an inner container (20) coaxially arranged in the outer container (10) and being adapted to be axially folded, said inner container (20) including a front end (22) having an inner outlet channel (24), a piston (32) displaceably arranged in the outer container (10) and being adapted to receive the folded inner container (20), the inner container (20) including at a rear end thereof a closed filling opening (52), the piston (32) including a central breast (37) formed at a projection (39) which extends into the inner container (20), the piston (32) includes two piston portions (33,36), said piston portions (33, 36) being provided with a respective annular piston breast (34, 48), and each piston portion (33,36) at its respective annular piston breast (34, 38) has a piston edge (35,38) supported on the wall of the outer container (10).

2. Two-component cartridge according to claim 1 wherein the projection (39) together with at least one of a recess (40) of the piston (32) and a constricted portion of the outer container (10) form an annular space (41) which receives the folded inner container (20) when the piston is in the advanced position.

3. Two-component cartridge according to claim 2 wherein the piston (32) includes behind the annular space (41) a sealing insertion zone (42) for the wall of the inner container (20).

4. Two-component cartridge according to claim 3 wherein a bellows-type section (21) of the inner container (20) is so corrugated that in the folded condition the bellows-type section (21) is jammed in the annular space (41) and sealingly fills the latter.

5. Two-component cartridge according to claim 4 wherein the bellows-type section (21) is made of metal.

6. Two-component cartridge according to claim 3 wherein a supporting surface (50) forms part of a pocket (49).

7. Two-component cartridge according to claim 1 wherein the inner container (20) is configured as a bellows-type section (21) with corrugated folding proceeding from rear to front.

8. Two-component cartridge according to claim 7 wherein the bellows-type section (21) is made of metal.

9. Two-component cartridge according to claim 1 wherein the outlet channel (24) of the inner container (20) includes circumferential ribs (26) on the outside which squeeze into longitudinal webs (27) in the outlet channel (14) of the outer container (10) and effect axial protection of the inner container (20).

10. Two-component cartridge according to claim 1 wherein the outer container (10) is at least partly made of translucent material and is provided with a scale indicating the respective state of evacuation on the basis of piston position.

11. Two-component cartridge according to claim 1 wherein the piston portions (33, 36) are separate elements.

12. Two-component cartridge according to claim 1 wherein the piston portions (33, 36) are separate elements, and one of said piston portions (33, 36) includes the central piston breast (37) housed in said inner container (20).

13. Two-component cartridge according to claim 1 wherein the piston portions (33, 36) are separate elements, one of said piston portions (33, 36) includes the central piston breast (37) housed in said inner container (20), and one of said piston portions (33, 36) includes a supporting surface (50) for supporting and advancing the other of said piston portions (33, 36).

14. Two-component cartridge according to claim 13 wherein the projection (39) together with at least one of a recess (40) of the piston (32) and a constricted portion of the outer container (10) form an annular space (41) which receives the folded inner container (20) when the piston is in the advanced position.

15. Two-component cartridge according to claim 14 wherein the piston (32) includes-behind the annular space (41) a sealing insertion zone (42) for the wall of the inner container (20).

16. Two-component cartridge according to claim 13 wherein the outlet channel (24) of the inner container (20) includes circumferential ribs (26) on the outside which squeeze into longitudinal webs (27) in the outlet channel (14) of the outer container (10) and effect axial protection of the inner container (20).

17. Two-component cartridge according to claim 13 wherein the outer container (10) is at least partly made of translucent material and is provided with a scale indicating the respective state of evacuation on the basis of piston position.

* * * * *